US006360566B1

(12) United States Patent
Koike

(10) Patent No.: US 6,360,566 B1
(45) Date of Patent: Mar. 26, 2002

(54) HOUSEHOLD CIRCULAR KNITTING MACHINE

(75) Inventor: Fuji Koike, Nagoya (JP)

(73) Assignees: Hamanaka Co., Ltd., Kyoto; Royal Industries Co., Ltd., Nagoya, both of (JP)

( * ) Notice: Subject to any disclaimer, the term of this patent is extended or adjusted under 35 U.S.C. 154(b) by 0 days.

(21) Appl. No.: 09/570,274

(22) Filed: May 12, 2000

(30) Foreign Application Priority Data

Jun. 18, 1999 (JP) ..... 11-004442 U

(51) Int. Cl.[7] ..... D04B 9/00
(52) U.S. Cl. ..... 66/8
(58) Field of Search ..... 66/1 R, 1 A, 8, 66/13, 17, 56; 446/474

(56) References Cited

U.S. PATENT DOCUMENTS 96,531 A * 11/1869 Work ..... 66/8
459,827 A * 9/1891 Gulick et al. ..... 66/8
2,021,301 A * 11/1935 Gast ..... 66/8
2,574,701 A * 11/1951 Malis ..... 66/8
3,983,719 A * 10/1976 Rich et al. ..... 66/8
4,674,300 A * 6/1987 Thompson, Jr. ..... 66/8
6,276,986 B1 * 8/2001 Wu ..... 66/8

* cited by examiner

*Primary Examiner*—Danny Worrell
(74) *Attorney, Agent, or Firm*—Koda & Androlia

(57) ABSTRACT

A household circular knitting machine includes a casing body having a central hollow interior having a circular section, the casing body including a bottom, a cylindrical holder rotatably mounted in the hollow interior of the casing body, the holder having an outer wall on which a first bevel gear is mounted, a ring cam fixed on the casing body so as to be coaxial with the holder, a rotational shaft rotatably mounted on the casing body and having one of two ends on which a second bevel gear is mounted and the other end on which a handle is mounted, the second bevel gear having a smaller diameter than the first bevel gear and meshing with the first bevel gear. Wool yarn is hooked on a hook of every second needle and the handle is operated to rotate the holder so that the knitting needles attached in the vertical grooves respectively are moved up and down by cam action, whereupon the wool yarn is knitted into a fabric, which is discharged out of the casing body through the hollow interior of thereof. At least two support legs are detachably mounted on the bottom of the casing body so as to define, below the casing body, a space through which the knitted fabric is discharged.

2 Claims, 8 Drawing Sheets

HOUSEHOLD CIRCULAR KNITTING MACHINE

BACKGROUND OF THE INVENTION

1. Field of the Invention

This invention relates to a household circular knitting machine for knitting mufflers or the like.

2. Description of the Prior Art

One of conventional household circular knitting machines comprises a casing body having a central hollow interior having a circular section and a cylindrical holder rotatably mounted in the hollow interior of the casing body. A ring cam is fixed on the casing body so as to be coaxial with the holder. A rotational shaft is rotatably mounted on the casing body. The holder has an inner wall having a number of vertical grooves spaced into an annular arrangement. One knitting needle is provided to be vertically moved into and out of each vertical groove. The holder has an outer wall provided with a bevel gear having a generally large diameter. The ring cam has a cam face including an angled portion and a flat portion continuous to the angled portion. A lower end of each needle is abutted against the cam face. The rotational shaft has one end on which another bevel gear having a smaller diameter is mounted. The large bevel gear is brought into mesh engagement with the small bevel gear. The shaft further has the other end to which a handle is connected.

Wool yarn is hooked on a hook of every second needle. The handle is then operated to rotate the holder so that the knitting needles attached in the vertical grooves respectively are moved up and down by the cam action. As a result, the wool yarn is knitted into a knitting fabric. The knitted fabric is discharged little by little out of the hollow interior of the casing body through an opening formed through a lower portion of the side wall of the casing body.

In a case where the knitted goods are long, for example, a muffler, the knitted fabric is twined when discharged through the opening. Since the opening is narrow, the fabric does not naturally untwine. Accordingly, an untwining work is often required.

Further, the casing body moves when the handle is operated. Thus, it is difficult to turn the handle. The casing body needs to be held down with a hand when the handle is turned. As a result, the conventional knitting machine is inconvenient.

SUMMARY OF THE INVENTION

Therefore, an object of the present invention is to provide a knitting machine which can easily untwine the fabric and which is convenient.

The present invention provides a knitting machine comprising a casing body having a central hollow interior having a circular section, the casing body including a bottom, a cylindrical holder rotatably mounted in the hollow interior of the casing body, the holder having a number of vertical grooves formed in an inner circumference thereof so as to be annularly arranged at regular intervals, so that one knitting needle is inserted into each groove so as to be vertically moved into and out of each groove, the holder having an outer wall on which a first bevel gear is mounted, a ring cam fixed on the casing body so as to be coaxial with the holder, the cam having a cam face including an angled portion and a flat portion continuous with the angled portion, each knitting needle abutting the cam face, and a rotational shaft rotatably mounted on the casing body and having one of two ends on which a second bevel gear is mounted and the other end on which a handle is mounted, the second bevel gear having a smaller diameter than the first bevel gear and meshing with the first bevel gear. In the knitting machine, wool yarn is hooked on a hook of every second needle and the handle is operated to rotate the holder so that the knitting needles attached in the vertical grooves respectively are moved up and down by cam action, whereupon the wool yarn is knitted into a fabric, which is discharged out of the casing body through the hollow interior of thereof. The knitting machine further comprises at least two support legs detachably mounted on the bottom of the casing body so as to define, below the casing body, a space through which the knitted fabric is discharged.

According to the above-described construction, the support legs are mounted on the bottom of the casing body so as to define, below the casing body, a space through which the knitted fabric is discharged. Accordingly, the knitted fabric easily untwines even in the case where the knitted fabric is twined when discharged out of the casing body. Consequently, the fabric can smoothly be knitted.

In a preferred form, the knitting machine further comprises a fixture including a bolt having a hook engaging each one of the support legs, a bracket having a boss loosely fitted with the bolt and a presser formed integrally on the boss, and a nut screwed down on the bolt. In this machine, the hook is engaged with each support leg of the casing body placed on a working table and the nut is tightened up so that the bracket is pressed against an underside of the working table, whereupon the casing body is fixed to the working table.

The knitting machine is fixed on a side edge of the working table by the fixture. Accordingly, the casing body need not be pressed down by hand so as not to be moved. Consequently, the convenience of the knitting machine can be improved. Furthermore, since the fabric discharged out of the casing body hangs down from the table, it can easily untwine.

BRIEF DESCRIPTION OF THE DRAWINGS

Other objects, features and advantages of the present invention will become clear upon reviewing the following description of the preferred embodiment, made with reference to the accompanying drawings, in which.

DETAILED DESCRIPTION OF THE PREFERRED EMBODIMENT

One embodiment of the present invention will be described with reference to the accompanying drawings.

Figure 1:
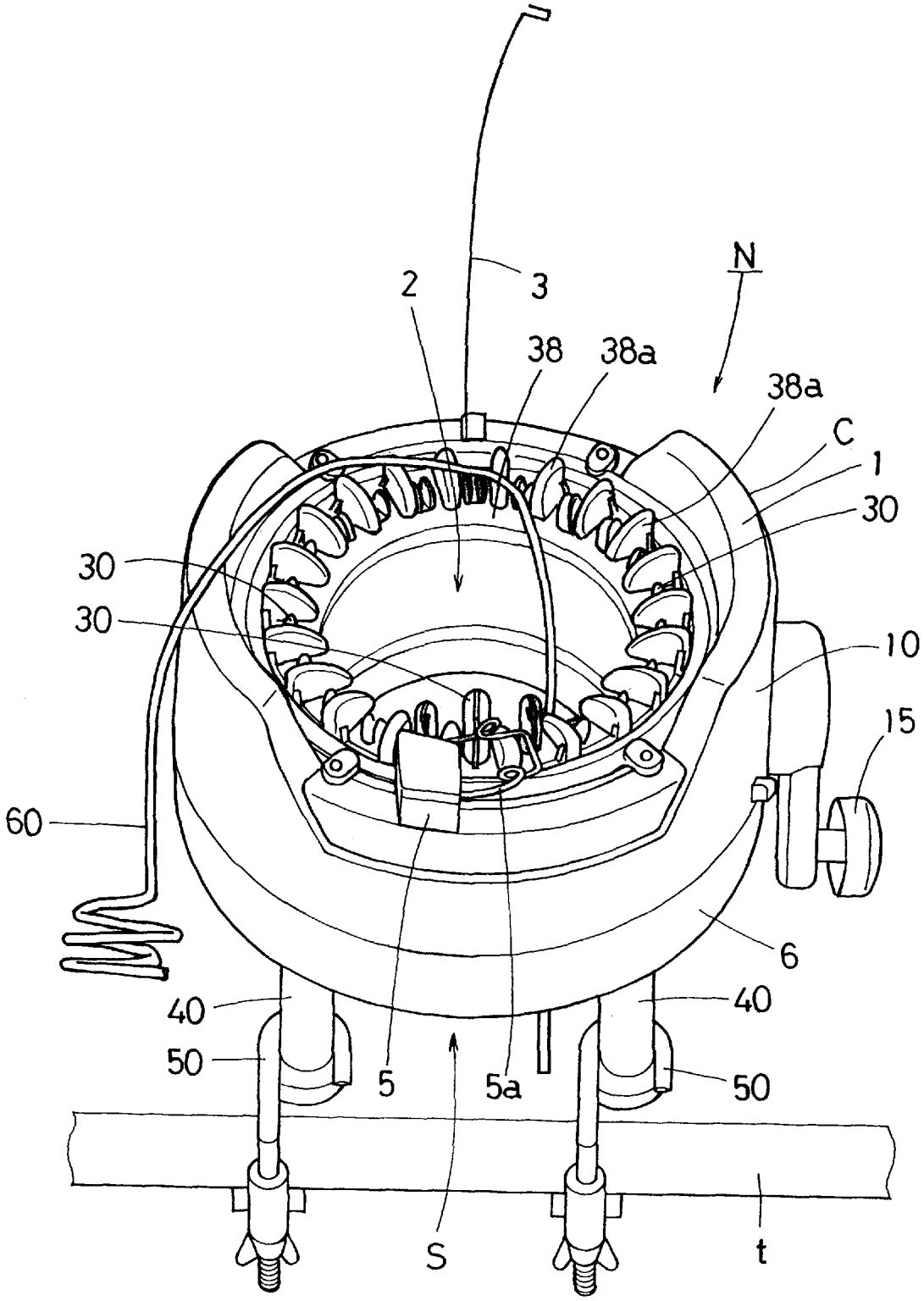
FIG. 1 is a perspective view of a household circular knitting machine of one embodiment in accordance with the present invention.

Referring first to FIG. 1, the household circular knitting machine N of the embodiment is shown. The machine N comprises a casing body C made of a synthetic resin. The casing body C includes an upper casing 1, a middle casing 10 and a lower casing 6. The casing body 1 has a central hollow interior 2 having a circular section. A thread feeder 5 having a thread guide 5*a* is provided on an upper edge of the casing body C. A tension guide 3 is also provided on the upper edge of the casing body C so as to be opposed to the thread feeder 5.

Figure 2:
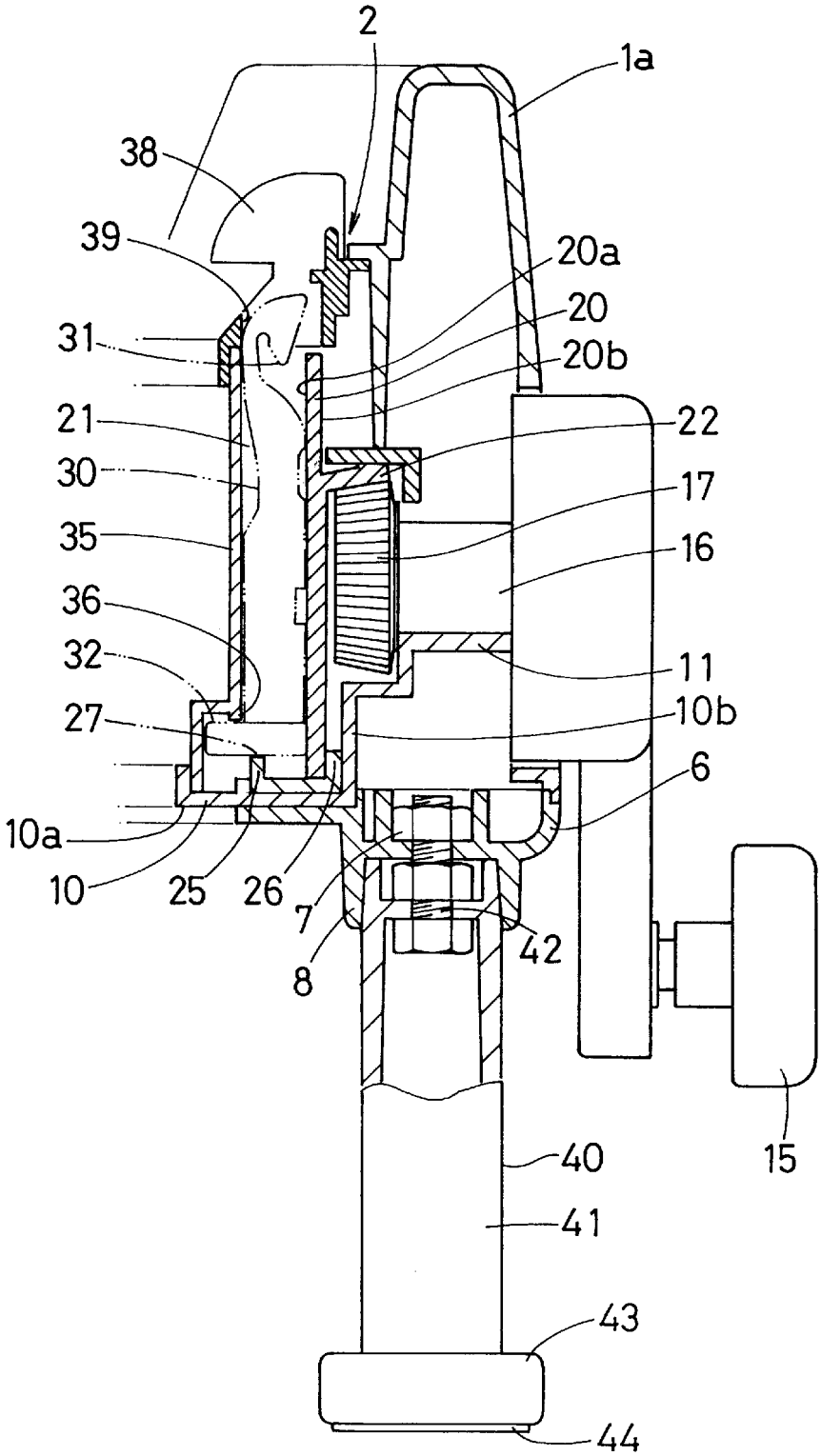
FIG. 2 is a partially broken front view of the knitting machine.
Figure 4:
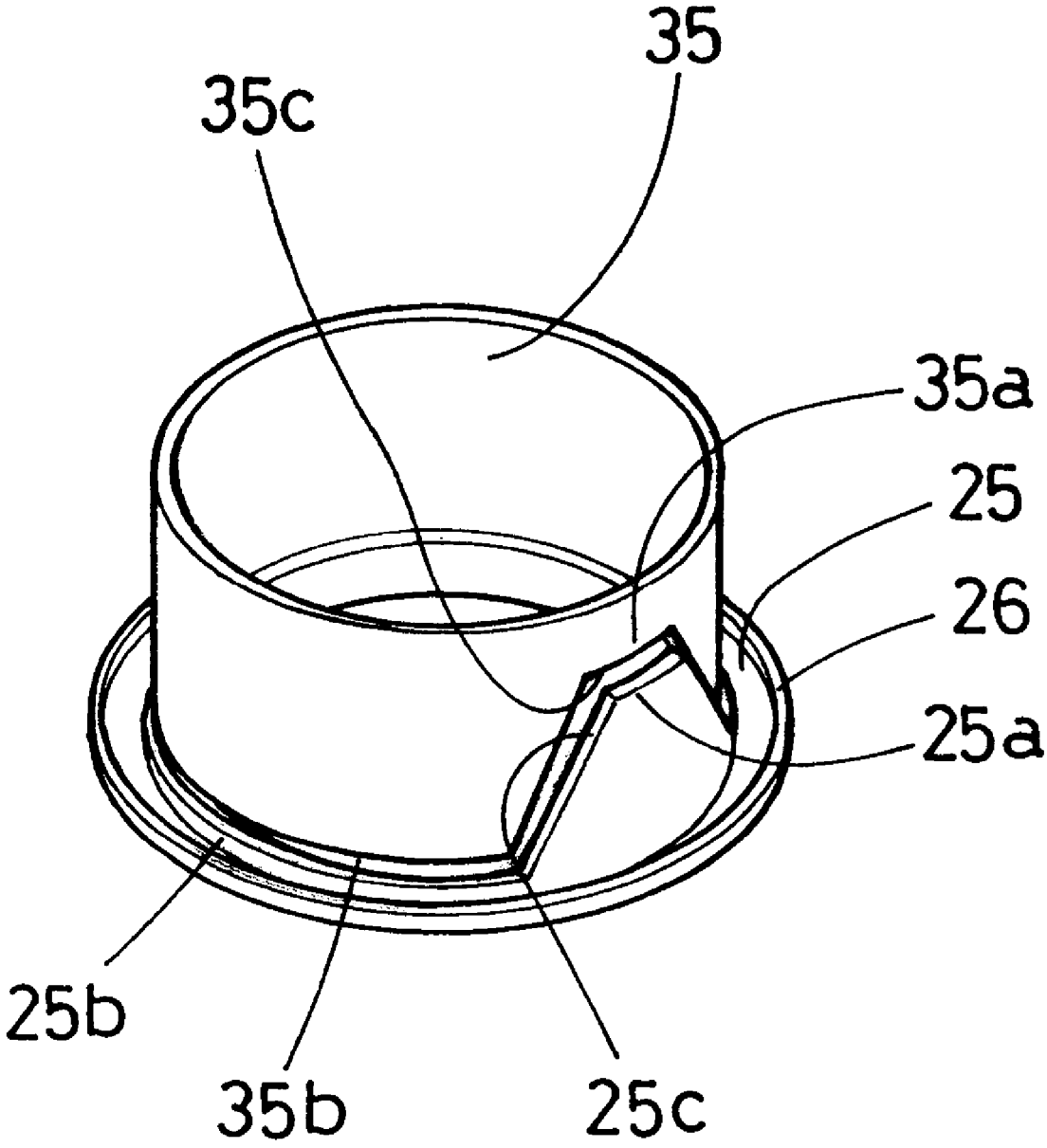
FIG. 4 is a perspective view of a cam plate and a cylinder cam.

The middle casing 10 includes a ring seat 10*a* formed integrally on the inner circumferential face thereof as shown in FIG. 2. The middle casing 10 further includes a bearing 11 on which a rotational shaft 16 is rotatably mounted. A bevel gear 17 is mounted on an inner end of the shaft 16. An outer end of the shaft 16 is connected to a handle 15. A ring flat cam 25 and a cylinder cam 35 are secured to the seat 10*a* of the middle casing 10. The flat cam 25 has an upwardly directed cam face 25*c* including a single angled portion 25*a* and a flat portion 25*b* continuous with the angled portion 25*a* as shown in FIG. 4. The flat cam 25 further has a ring guide 26 concentric with the cam face 25*c*. A cylindrical holder 20 is rotatably fitted in the guide 26.

The cylinder cam 35 also has a downwardly directed cam face 35*c* including a single angled portion 35*a* and a flat portion 35*b* continuous with the angled portion 35*a*. The cylinder cam 35 and the flat cam 25 are disposed to be concentric with each other so that the downward cam face 25*c* and the upward cam face 35*c* are spaced from each other and so that the angled portions 25*a* and 35*a* of the cam faces 25*c* and 35*c* are located near the thread feeder 5.

The holder 20 has a number of vertical grooves 20*a* formed in an inner circumferential face thereof so as to be annularly arranged at regular intervals. One knitting needle 30 is disposed in each of the vertical grooves 20*a* so as to be moved up and down. A bevel gear 22 having a larger diameter than the bevel gear 17 is provided on the outer circumference of the holder 20. The large bevel gear 22 is in mesh engagement with the small bevel gear 17 mounted on the shaft 16. Each needle 30 has an upper end formed with a hook 31 and a lower end formed with a pin-shaped cam follower 32. The cam follower 32 is in abutment with the upward cam face 25*c* of the flat cam 25 and the downward cam face 35*c* of the cylinder cam 35. The cylinder cam 35 has an upper end to which a working cover 38 is secured. The working cover 38 has a number of annularly disposed thread guides 38*a*. An opening 39 is defined between each thread guide 38*a* and the adjacent one. Each needle 30 is caused to go into and out of the corresponding opening 39.

Four bosses 8 are provided on the lower casing 6 constituting a bottom of the casing body C. Four support legs 40 are mounted to the bosses 8 respectively so that a space S through which a knitted fabric passes is defined below the casing body C. A nut 7 is fixed in each boss 8 of the lower casing 6. A bolt 42 is fixed to an upper end of each support leg 40. Each bolt 42 has a distal end projecting from an upper end face of the corresponding boss 8. A pedestal 43 having a larger diameter than a middle portion 41 of each support leg 40 is mounted on the lower end of each support leg 40. A rubber piece 44 is secured to the backside of each pedestal 43. The bolt 42 is screwed into the nut 7 so that each support leg 40 is detachably mounted on the bottom of the casing body C.

Figure 5:
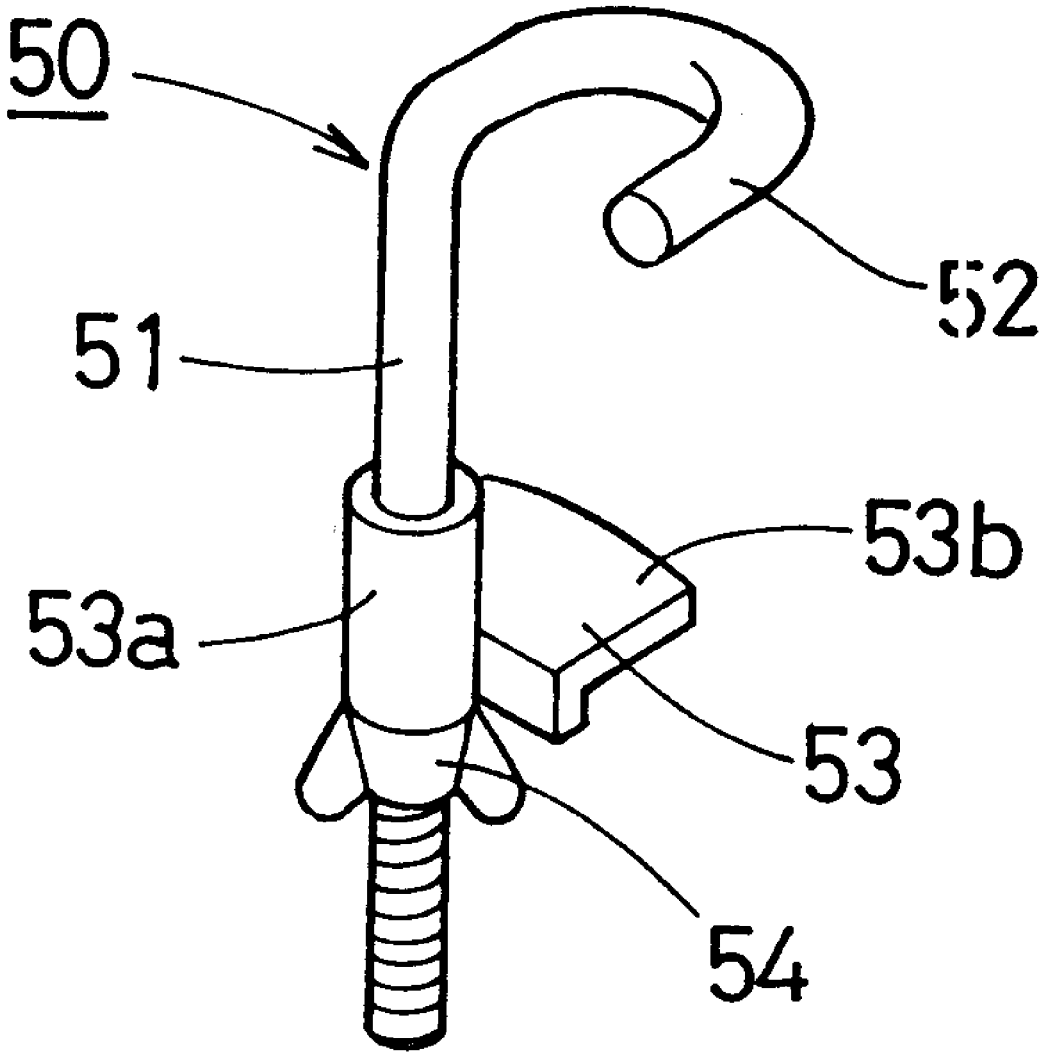
FIG. 5 is a perspective view of a fixture.

The household circular knitting machine N is provided with fixtures 50 as shown in FIG. 5. Each fixture 50 includes a bolt 51 having an integrally formed generally U-shaped hook 52 engaging the pedestal 43 of each support leg 40, a bracket 53 having a boss 53*a* loosely fitted with the bolt 51 and a presser 53*b* formed integrally on the boss 53*a*, and a nut 54 screwed down on the bolt 51.

Figure 6:
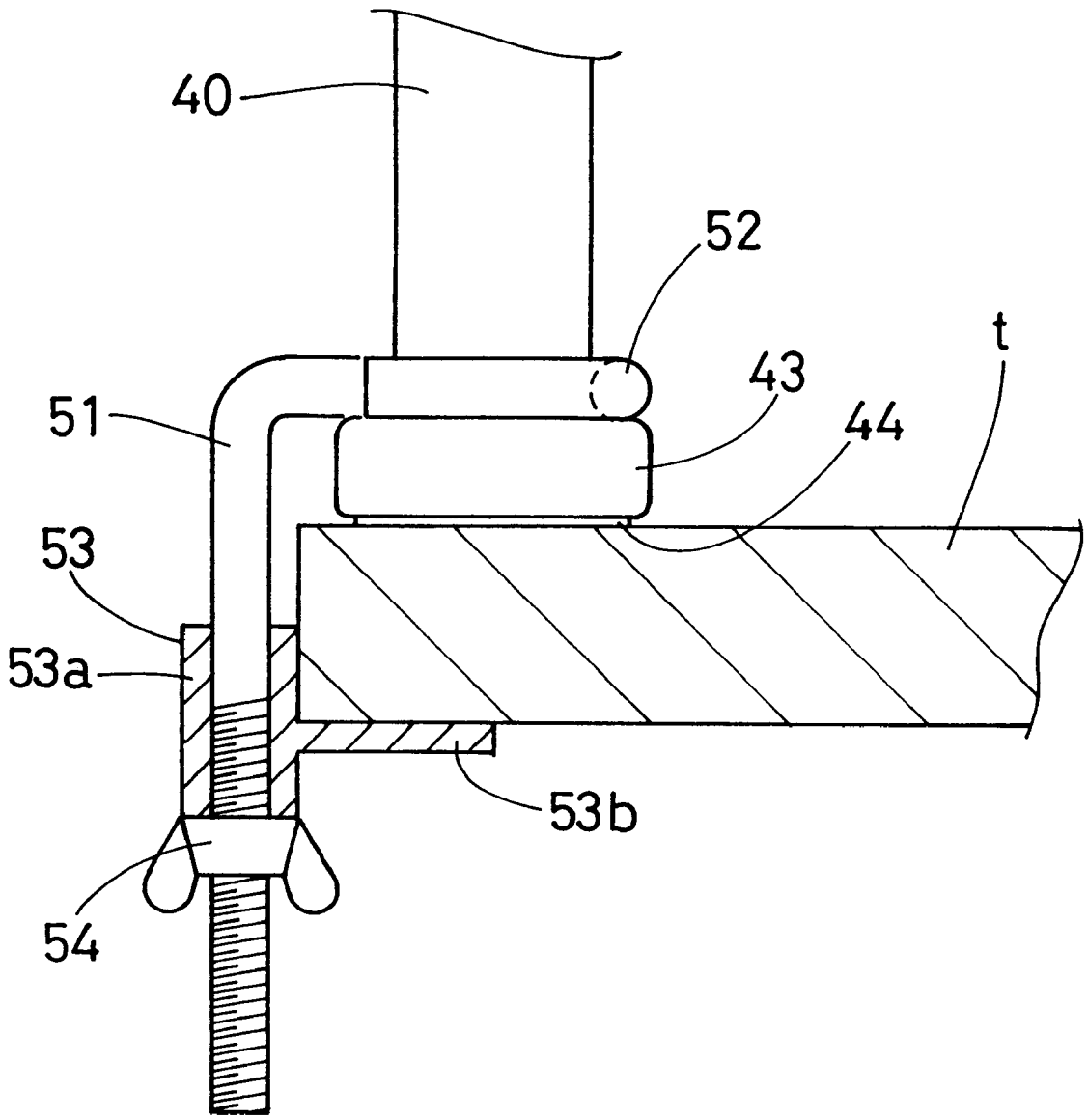
FIG. 6 illustrates the fixture fixing the knitting machine to the working table.
Figure 7:
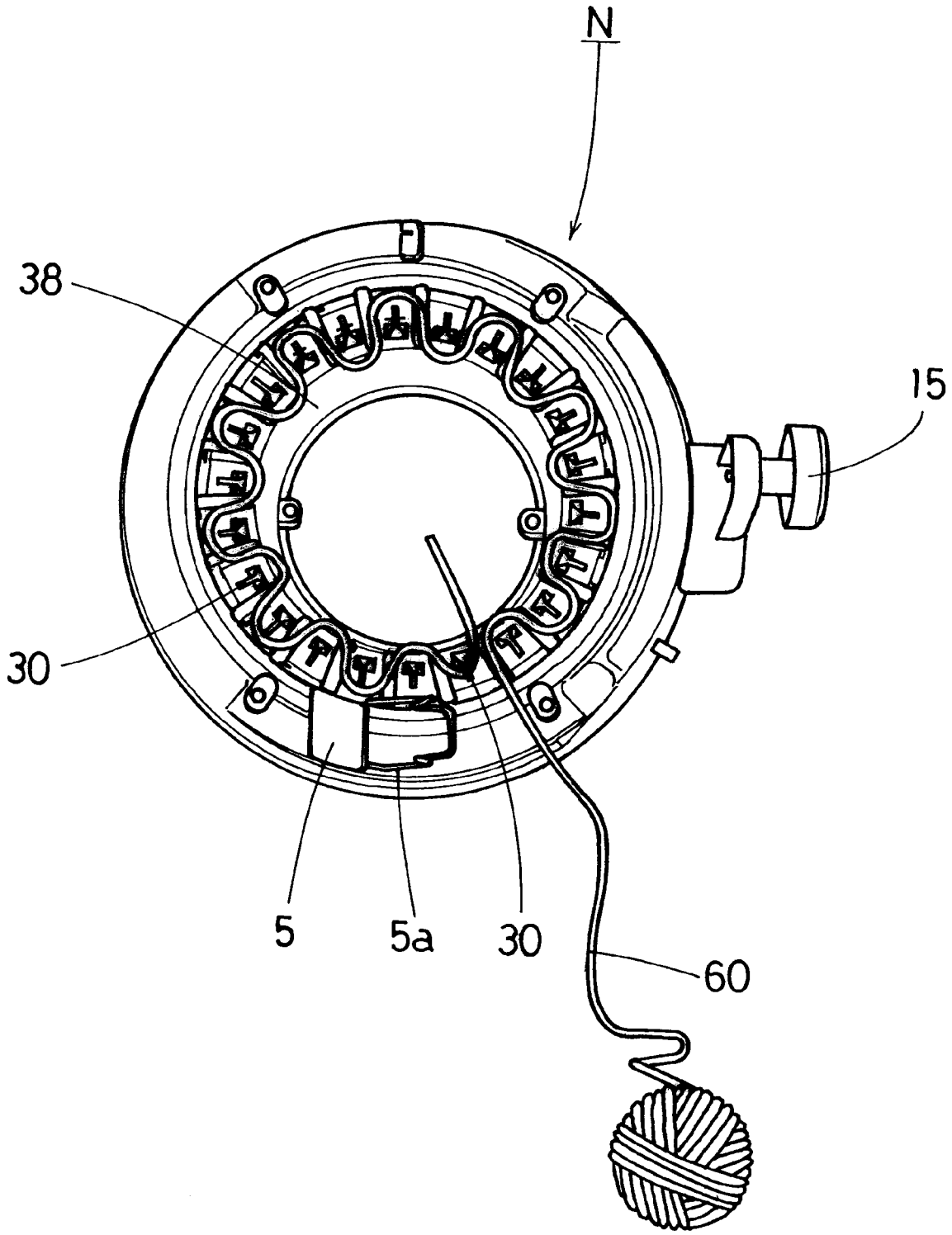
FIG. 7 illustrates a manner of using the knitting machine.

The operation of the household circular knitting machine N will now be described. The hook 52 of each fixture 50 is caused to engage the pedestal 43 of the support leg 40 on the working table t as shown in FIG. 6. The nut 54 is tightened up so that the bracket 53 is pressed against the backside of the table t. As a result, the casing body 1 is fixed to the table t. Wool yarn 60 is hooked on the hook 31 of the starting needle 30 located near thethread feeder 5. The wool yarn 60 is then loosely hooked on the front and rear portions of the adjacent needles 30 alternately, being extended one turn along the working cover 38. The wool yarn 60 is then caused to pass through the thread guide 5*a* of the thread feeder 5 and then through the tension guide 3.

Figure 3:
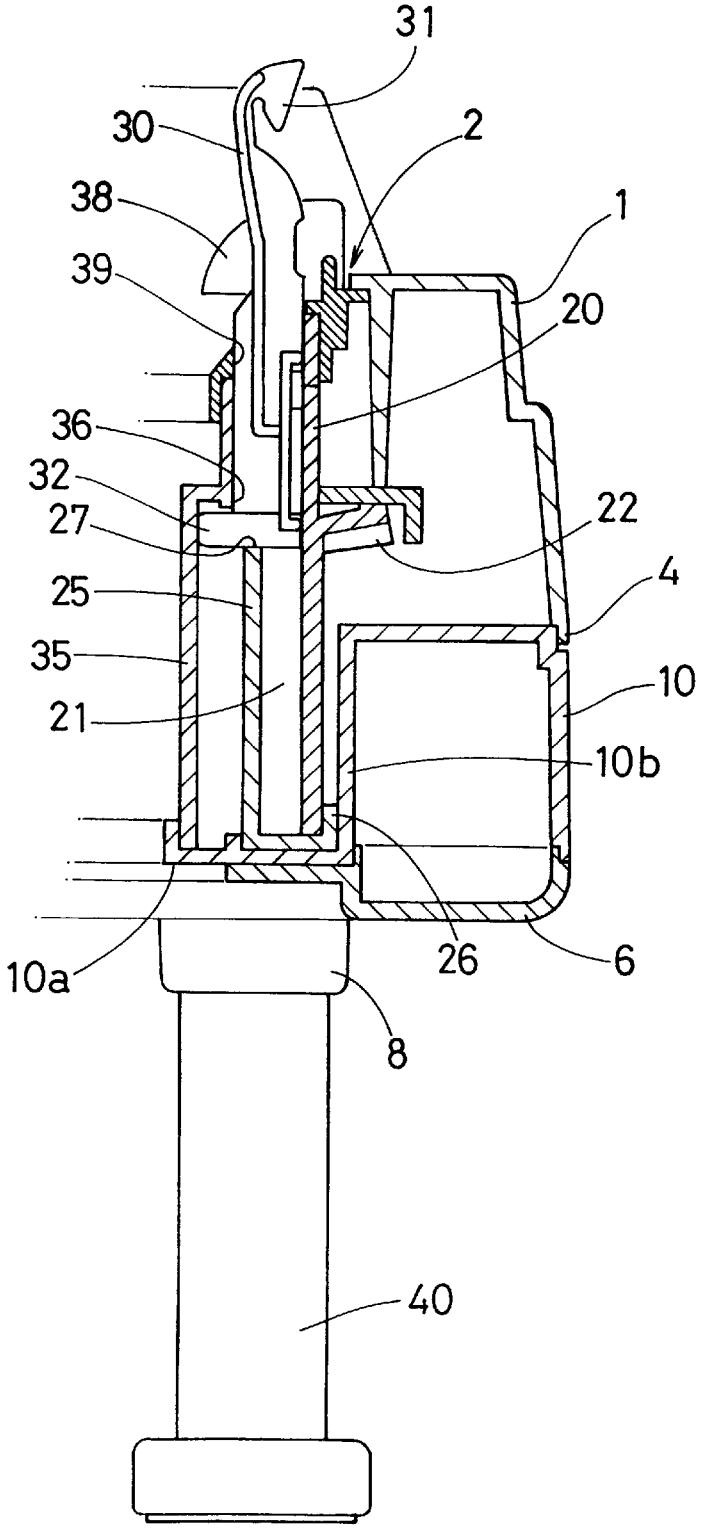
FIG. 3 is a front view of the knitting machine, showing the relationship between knitting needles and a fixed cam.

The handle 15 is then turned clockwise slowly so that the small bevel gear 17 provided on the end of the shaft 16 is rotated. As a result, the holder 20 is rotated so that each of the needles 30 disposed in the respective vertical grooves 20*a* is moved while the cam follower 32 is being slid on the cam faces 25*c* and 35*c* of the flat cam 25 and the cylinder cam 35 respectively. When passing the flat portions 25*b* and 35*b*, each needle 30 assumes the lowest stroke end and is not moved up and down. Each needle 30 is moved up and down along the angled cam faces 25*c* and 35*c* when passing the angled portions 25*a* and 35*a*. Each needle 30 assumes the highest position when passing the apexes of the angled portions 25*a* and 35*a* as shown in FIG. 3.

Figure 8:
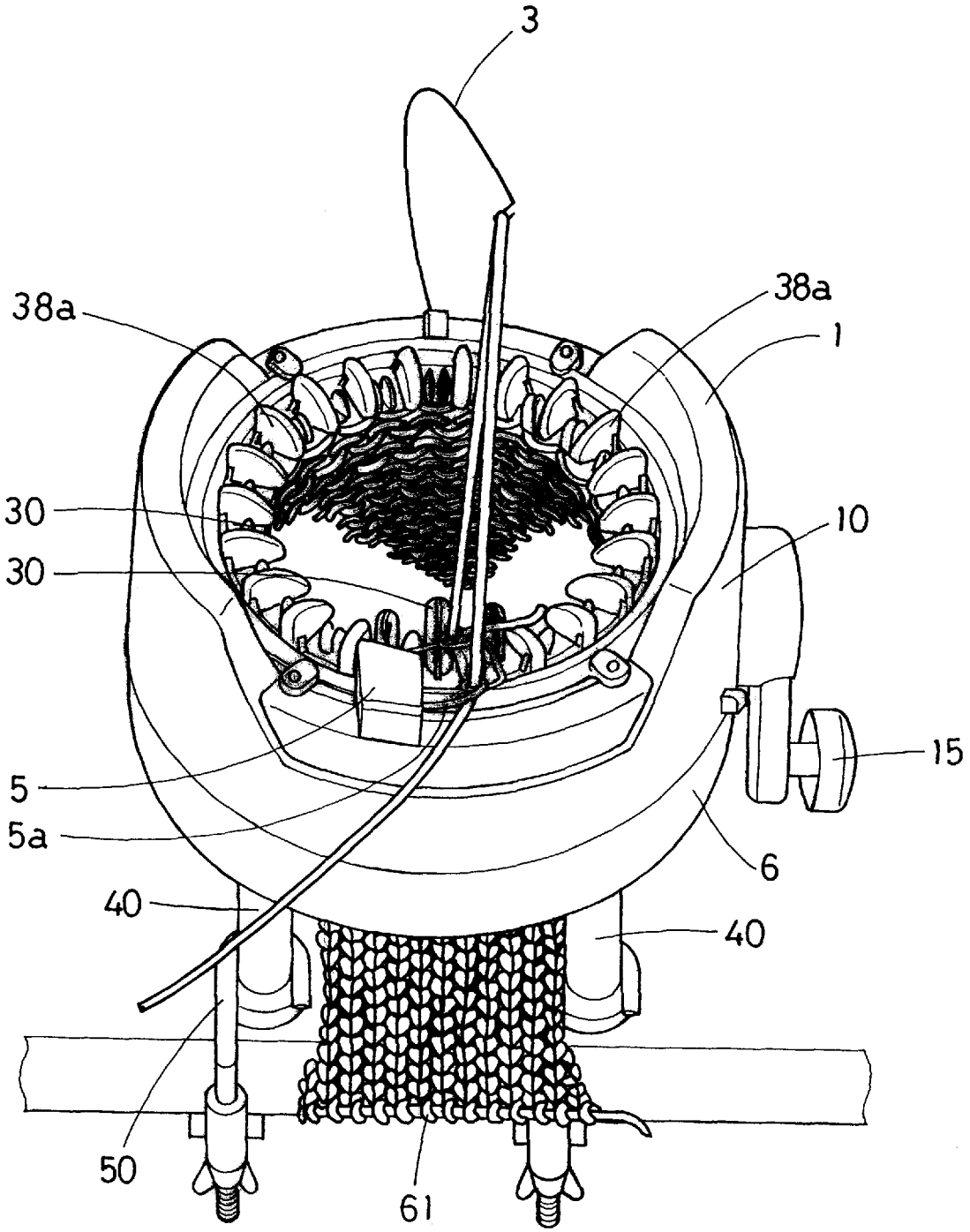
FIG. 8 is a perspective view of the knitting machine, showing the manner of using the machine.

Each needle 30 is thus moved up and down when passing the angled portions 25*a* and 35*a* of the respective cam faces 25*c* and 35*c*, whereupon the wool yarn 60 is knitted into a fabric 61 as shown in FIG. 8. The knitted fabric 61 is discharged out of the lower end opening of the hollow interior 2 of the casing body C. When becoming long, the fabric 61 is drawn frontward out of the space S formed between the support legs.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A knitting machine comprising:

a casing body having a central hollow interior having a circular section, the casing body including a bottom;

a cylindrical holder rotatably mounted in the hollow interior of the casing body, the holder having a number of vertical grooves formed in an inner circumference thereof so as to be annularly arranged at regular intervals, so that one knitting needle is inserted into each groove so as to be vertically moved into and out of each groove, the holder having an outer wall on which a first bevel gear is mounted;

a ring cam fixed on the casing body so as to be coaxial with the holder, the cam having a cam face including an angled portion and a flat portion continuous with the angled portion, each knitting needle abutting the cam face; and a rotational shaft rotatably mounted on the casing body and having one of two ends on which a second bevel gear is mounted and the other end on which a handle is mounted, the second bevel gear having a smaller diameter than the first bevel gear and meshing with the first bevel gear;

wherein wool yarn is hooked on a hook of every second needle and the handle is operated to rotate the holder so that the knitting needles attached in the vertical grooves respectively are moved up and down by cam action, whereupon the wool yarn is knitted into a fabric, which is discharged out of the casing body through the hollow interior of thereof, the knitting machine further comprising:

at least two support legs detachably mounted on the bottom of the casing body so as to define, below the casing body, a space through which the knitted fabric is discharged.

2. The knitting machine according to claim 1, further comprising a fixture including a bolt having a hook engaging each one of the support legs, a bracket having a boss loosely fitted with the bolt and a presser formed integrally on the boss, and a nut screwed down on the bolt, wherein the hook is engaged with each support leg of the casing body placed on a working table and the nut is tightened up so that the bracket is pressed against an underside of the working table, whereupon the casing body is fixed to the working table.

* * * * *